United States Patent [19]

Caliendo

[11] 4,047,645

[45] Sept. 13, 1977

[54] AEROSOL DEVICE WITH TELESCOPING CONTAINER PARTS

[76] Inventor: Joseph L. Caliendo, 578 Driggs Ave., Brooklyn, N.Y. 11211

[21] Appl. No.: 693,867

[22] Filed: June 8, 1976

[51] Int. Cl.[2] ..... B65D 35/28

[52] U.S. Cl. ..... 222/386.5; 222/389; 222/390; 222/398

[58] Field of Search ..... 239/322, 323, 324, 330; 222/390, 401, 386.5, 389, 398, 95

[56] References Cited

U.S. PATENT DOCUMENTS

| | | | |
|---|---|---|---|
| 1,930,037 | 10/1933 | Brubaker | 222/390 X |
| 3,561,644 | 2/1971 | Works et al. | 222/95 |
| 3,815,787 | 6/1974 | Spies | 222/390 X |
| 3,873,003 | 3/1975 | Selferth et al. | 222/95 |

FOREIGN PATENT DOCUMENTS

| | | | |
|---|---|---|---|
| 725,121 | 5/1932 | France | 222/401 |
| 763,931 | 5/1934 | France | 222/401 |

*Primary Examiner*—Robert B. Reeves
*Assistant Examiner*—David A. Scherbel
*Attorney, Agent, or Firm*—Daniel Jay Tick

[57] ABSTRACT

An airtight container has fluid material therein under pressure. The pressure on the fluid material in the container is manually increased. A spray valve in the container sprays the fluid material out of the container under manual control.

7 Claims, 4 Drawing Figures

AEROSOL DEVICE WITH TELESCOPING CONTAINER PARTS

BACKGROUND OF THE INVENTION

The present invention relates to an aerosol device.

Known aerosol devices utilize freon or similar gases under pressure. Such gases, and especially freon, are dangerous to human life, since they are apt to explode at high temperatures, pollute the atmosphere, and have been found to be contributing causes of disease, such as cancer and blindness, as indicated by medical evidence. The gases also cause toxic, and even fatal, reactions when absorbed by the human body.

The principal object of the invention is to provide an aerosol device which eliminates the use of harmful gases such as freon.

An object of the invention is to provide an aerosol device which is safe from exploding at temperatures at which freon and similar gases may explode.

Another object of the invention is to provide an aerosol device which does not pollute the atmosphere by destroying the valuable protective ozone layer around the Earth permitting harmful rays of the sun to penetrate the atmosphere, resulting in disease or blindness in human or animal.

Yet another object of the invention is to provide an aerosol device which is of simple structure, is inexpensive in manufacture and is efficient, effective and reliable in operation.

Another object of the invention is to provide an aerosol device which is easy to use and occupies a smaller volume as it is used, saving valuable storage space.

Still another object of the invention is to provide an aerosol device which improves efficiency and reduces transportation costs by reducing volume, handling and storage costs when it is shipped from its point of origin to a canning facility in a collapsed condition.

Yet another object of the invention is to provide an aerosol device which reduces pollution, since it occupies a minimum space when it is discarded, after depletion, in collapsed condition and also reduces bulk in disposal as garbage.

Another object of the invention is to provide an aerosol device which is adjustable to a desired volume capacity and which functions efficiently, effectively and reliably to store liquid material in a leakproof, safe and secure manner.

BRIEF SUMMARY OF THE INVENTION

In accordance with the invention, an aerosol device comprises an airtight container having fluid material therein under pressure. Pressure means manually increases the pressure on the fluid material in the container means. A spray valve in the container sprays the fluid material out of the container under manual control.

The container and pressure means comprise a pair of containers telescopically slidably mounted one within another, the upper container being mounted in the lower container. The lower container has a larger diameter for movement in axial directions.

An airtight flexible membrane in the containers contains fluid material under pressure. The membrane covers the inside surfaces of the containers and constitutes a completely sealed chamber having the fluid material therein under pressure. The spray valve opens in the chamber.

An airtight and liquid tight partition sheet extends across the membrane and divides the membrane into a first completely sealed chamber containing compressed air and a second completely sealed chamber having the fluid material therein. The spray valve opens in the second chamber.

The spray valve is in the upper container. The spray valve opens at one end in the membrane and is airtightly sealed in the membrane and opens at the other end outside the container in a manner whereby when the spray valve is manually depressed it sprays the fluid out of the container and as the containers are moved toward each other in axial direction the pressure on the fluid in the membrane increases.

The container and pressure means comprise a pair of substantially hollow cylindrical containers coaxially positioned in telescopic relation to each other. Each of the containers has a substantially cylindrical wall having an inner cylindrical surface and an outer cylindrical surface. A substantially helical inner guide threadedly guides the lower container on, around the outer surface of, and in axial directions of the upper container therewithin. A substantially helical outer guide threadedly guides the upper container in, around the inner surface of, and in axial directions of the lower container thereon whereby the containers are rotatable from a closed position in which the containers are within the lower container having the larger diameter to an open position in which the containers are extended axially with the lowermost circumference of the upper container coupled to the uppermost circumference of the lower container.

A pair of pressure sealing rings are provided. The lower container has a first pressure sealing ring around its uppermost circumference on its inner surface and the upper container has a second pressure sealing ring around its lowermost circumference on its outer surface for providing an airtight coupling between the containers.

The inner and outer guides, respectively, comprise a substantially helical groove formed in the inner surface of a container and a substantially helical protrusion formed on the outer surface of the upper container threadedly coupled to the helical groove of the lower container. The helical groove of the lower container is threadedly coupled to the helical protrusion of the upper container.

BRIEF DESCRIPTION OF THE DRAWINGS

In order that the invention may be readily carried into effect, it will now be described with reference to the accompanying drawings, wherein.

In the FIGS., the same components are identified by the same reference numerals.

Figure 1:
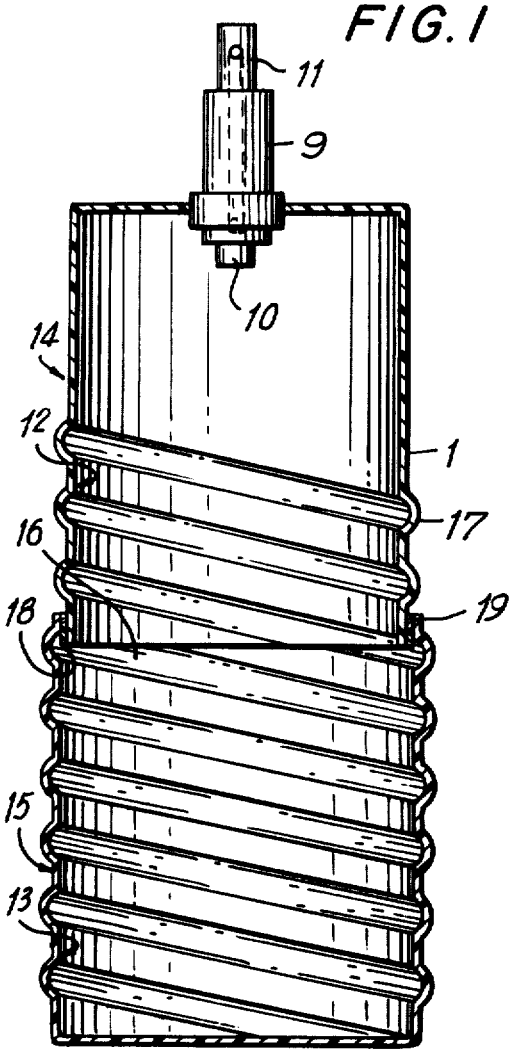
FIG. 1 is a sectional view of an embodiment of the aerosol device of the invention in its fully extended position.

DETAILED DESCRIPTION OF THE INVENTION:

The aerosol device of the invention comprises a pair of containers 1 and 2 (FIGS. 1 and 4) telescopically slidably mounted one within another. The upper container 1 is mounted in the lower container 2, which has a larger diameter. Each of the containers 1 and 2 is mounted for movement in axial directions indicated by the axis 3 and the arrows 4 and 5, shown in FIG. 4. Three, four, or more containers may be utilized, instead of the pair of containers disclosed.

Figure 4:
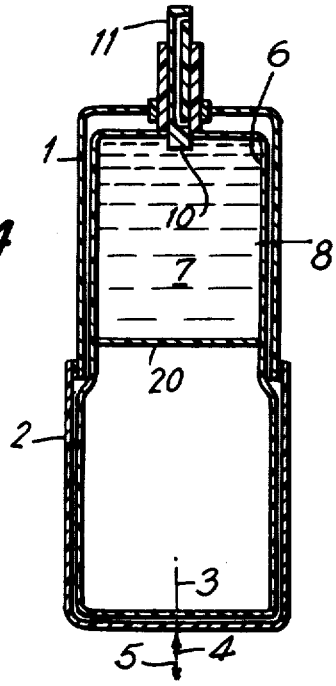
FIG. 4 is a cross-sectional view of the embodiment of FIG. 1 in simplified form.

An airtight and liquid tight flexible membrane 6 of any suitable material such as, for example, Latex, thin rubber or plastic, in the containers 1 and 2 contains fluid material 7 under pressure (FIG. 4). The fluid material 7 may comprise any fluid suitable for spraying such as, for example, deodorant, insecticide, and so on.

The membrane 6 covers the inside surfaces of the containers 1 and 2 and constitutes a completely sealed chamber 8 having the fluid material 7 therein under pressure.

A spray valve 9 of any suitable type is provided in the upper container 1 of smaller diameter (FIGS. 1 and 4). The spray valve 9 opens at one end 10 in the chamber of the membrane 6 and is airtightly sealed in the membrane (FIG. 4). The spray valve 9 opens at the other end 11 outside the container.

The substantially cylindrical containers 1 and 2 are coaxially positioned in telescopic relationship to each other, as shown in FIG. 1. Each of the containers 1 and 2 has a substantially cylindrical wall having an inner cylindrical surface 12 and 13, respectively, and an outer cylindrical surface 14 and 15, respectively.

A substantially helical inner guide 16 is provided in the lower container 2 for threadedly guiding the lower container on, around the outer surface of, and in axial directions of, the upper container 1 therewithin.

A substantially helical outer guide 17 is provided on the upper container 1 for threadedly guiding the upper container in, around the inner surface of, and in axial directions of, the lower container 2 thereon.

The containers 1 and 2 are thus rotatable from an open position, shown in FIG. 1, in which the containers are extended axially with the lowermost circumference of the upper container coupled to the uppermost circumference of the lower container, to a closed position (not shown in the FIGS.) in which the upper container is within the lower container.

Figure 2:
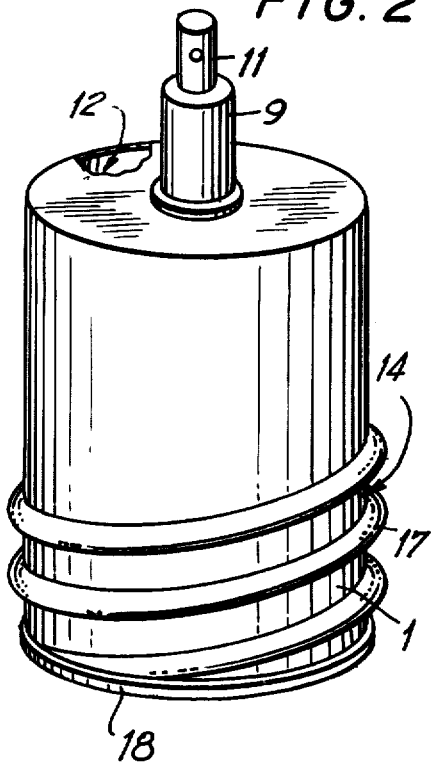
FIG. 2 is a perspective view of the upper container of the aerosol device of the invention.
Figure 3:
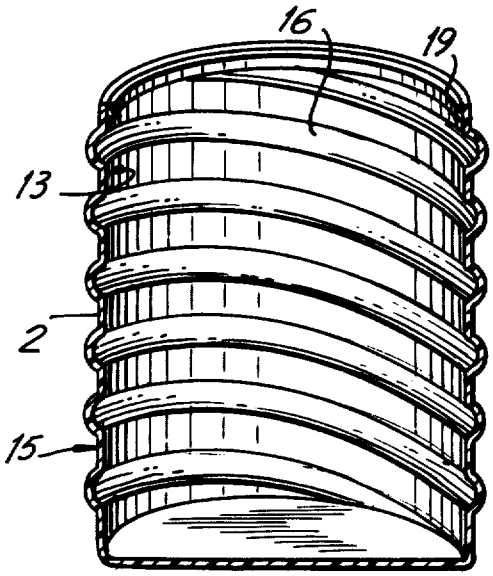
FIG. 3 is a sectional view of the lower container of the aerosol device of the invention which is normally coaxially positioned on the upper container of FIG. 2.

As shown in FIG. 3, the inner guide 16 of the lower container 2 in FIG. 3 comprises a substantially helical groove formed in the inner surface 13 of the container. As shown in FIG. 2, the outer guide 17 of the upper container 1 comprises a substantially helical protrusion formed on the outer surface 14 of the container. The outer guide of the upper container is threadedly coupled to the helical groove of the lower container and the helical groove of the lower container is threadedly coupled to the helical protrusion of the upper container.

A pair of pressure sealing rings are provided. The lower container has a first pressure sealing ring around its uppermost circumference on its inner surface and the upper container has a second pressure sealing ring around its lowermost circumference on its outer surface. Thus, the container 1 has a pressure sealing ring 18 around its lowermost circumference on its outer surface 14. The container 2 has a pressure sealing ring 19 around its uppermost circumference on its inner surface 13.

When the spray valve 9 is manually depressed, it sprays the fluid 7 out of the sealed chamber. As the containers 1 and 2 are moved toward each other, in axial direction, the pressure in the chamber 8 of the membrane 6 increases, since the pressure applied to the outside of the membrane increases. Thus, as the fluid 7 is sprayed out, and as the containers 1 and 2 are moved toward each other, the pressure on the membrane 6, and therefore on the fluid in said membrane, is maintained and the fluid is dispensed uniformly, since the movement of the containers toward each other further compresses said fluid. As the volume is diminished by moving the containers toward each other, the pressure increases. The inner and outer guides of the containers retain said containers in position at each stage of movement of said containers.

An airtight and liquid tight partition sheet 20 of any suitable material such as, for example, Latex, thin rubber or plastic extends across the membrane 6 and divides said membrane into a first completely sealed lower chamber filled with compressed air and a second completely sealed upper chamber having the fluid material 7 therein (FIG. 4). The ratio of the volume of the second or upper chamber to the volume of the first or lower chamber is approximately 40:60. The partition sheet 20 is preferably of the same airtight, liquid tight flexible material as the membrane 6. The spray valve 9 opens into the second chamber.

The movement of the containers 1 and 2 toward each other also further compresses the air in the first chamber in accordance with the law of physics that the pressure varies inversely as the volume. When the containers 1 and 2 are compressed to the extent that they are housed substantially one within the other, the pressure of the air in the first chamber, which remains at least as high as its initial value, causes the fluid 7 to continue to be dispensed via the valve 9 until it is exhausted. The fluid 7 in the upper chamber is thus completely exhausted, due to total dispensing thereof, when the containers 1 and 2 are compressed to the extent that they are housed substantially one within the other.

While the invention has been described by means of a specific example and in a specific embodiment, I do not wish to be limited thereto, for obvious modifications will occur to those skilled in the art without departing from the spirit and scope of the invention.

I claim:

1. An aerosol device, comprising airtight container means;

an airtight flexible membrane in the container means containing fluid material under pressure and compressed gas gastightly separated from the fluid material;

pressure means for manually increasing the pressure on the fluid material in the container means, the container means and pressure means comprising a pair of containers constituting an upper container and a lower container telescopically slidably mounted one within another, the upper container being mounted in the lower container, the lower container having a larger diameter for movement in axial directions, wherein dispensing pressure is maintained by gradually telescoping the upper and lower containers towards each other; and spray valve means in the container means for spraying the fluid material out of the container means under manual control.

2. An aerosol device as claimed in claim 1, wherein the spray valve means is in the upper container, said spray valve means opening at one end in the membrane and being airtightly sealed in the membrane and opening at the other end outside the container means in a manner whereby when the spray valve means is manually depressed it sprays the fluid material out of the container means and as the containers are moved toward each other in axial direction the pressure in the membrane increases.

3. An aerosol device as claimed in claim 1, wherein each of the containers of the container means and pressure means is of substantially hollow cylindrical configuration having a substantially cylindrical wall having an inner cylindrical surface and an outer cylindrical surface, substantially helical inner guide means for threadedly guiding the lower container on, around the outer surface of, and in axial directions of the upper container therewithin and substantially helical outer guide means for threadedly guiding the upper container in, around the inner surface of, and in axial directions of the lower container thereon whereby the containers are rotatable from a closed position in which the upper container is within the lower container having the larger diameter to an open position in which the containers are extended axially with the lowermost circumference of the upper container coupled to the uppermost circumference of the lower container.

4. An aerosol device as claimed in claim 3, wherein the container means and pressure means further comprise a pair of pressure sealing rings, and wherein the lower container has a first pressure sealing ring around its uppermost circumference on its inner surface and the upper container has a second pressure sealing ring around its lowermost circumference on its outer surface for providing an airtight coupling between the containers.

5. An aerosol device as claimed in claim 3, wherein the inner and outer guide means, respectively, of the container means and pressure means comprise a substantially helical groove formed in the inner surface of the lower container and a substantially helical protrusion formed on the outer surface of the upper container threadedly coupled to the helical groove of the lower container, the helical groove of the lower container being threadedly coupled to the helical protrusion of the upper container.

6. An aerosol device as claimed in claim 1, wherein the membrane covers the inside surfaces of the containers and constitutes a completely sealed chamber having the fluid material and the compressed gas therein under pressure in gastight separation from each other, said spray valve means opening in the fluid material in the chamber.

7. An aerosol device as claimed in claim 1, wherein the membrane covers the inside surfaces of the container and the compressed gas comprises compressed air, and further comprising an airtight and liquid tight partition sheet extending across the membrane and dividing the membrane into a first completely sealed chamber containing the compressed air and a second completely sealed chamber having the fluid material therein, said spray valve means opening in the second chamber.

* * * * *